US008325209B2

(12) United States Patent
Masutani et al.

(10) Patent No.: US 8,325,209 B2
(45) Date of Patent: Dec. 4, 2012

(54) RECORDING HEAD AND RECORDING APPARATUS PROVIDED WITH THE RECORDING HEAD

(75) Inventors: Hiroshi Masutani, Kirishima (JP); Kouji Ochi, Kirishima (JP); Tetsuya Ookubo, Kirishima (JP)

(73) Assignee: Kyocera Corporation, Kyoto (JP)

( * ) Notice: Subject to any disclaimer, the term of this patent is extended or adjusted under 35 U.S.C. 154(b) by 192 days.

(21) Appl. No.: 13/000,605

(22) PCT Filed: May 27, 2009

(86) PCT No.: PCT/JP2009/059707

§ 371 (c)(1),
(2), (4) Date: Dec. 21, 2010

(87) PCT Pub. No.: WO2009/157269

PCT Pub. Date: Dec. 30, 2009

(65) Prior Publication Data

US 2011/0187807 A1 Aug. 4, 2011

(30) Foreign Application Priority Data

Jun. 26, 2008 (JP) ..... 2008-167408

(51) Int. Cl.
*B41J 2/335* (2006.01)

(52) U.S. Cl. ..... 347/203

(58) Field of Classification Search ..... 347/200, 347/202, 203, 205

See application file for complete search history.

(56) References Cited

U.S. PATENT DOCUMENTS

| | | | | |
|---|---|---|---|---|
| 6,256,053 | B1 * | 7/2001 | Noshita | 347/203 |
| 6,483,528 | B1 * | 11/2002 | Yamade et al. | 347/203 |
| 6,558,563 | B2 | 5/2003 | Kashiwaya et al. | 216/41 |
| 7,046,265 | B2 * | 5/2006 | Shirakawa et al. | 347/202 |
| 7,212,222 | B2 * | 5/2007 | Yamakawa | 347/203 |
| 2001/0054598 | A1 | 12/2001 | Kashiwaya et al. | 216/41 |

FOREIGN PATENT DOCUMENTS

| | | | |
|---|---|---|---|
| JP | 06036210 | A | 2/1994 |
| JP | 7-132628 | | 5/1995 |
| JP | 8-112923 | | 5/1996 |
| JP | 08112923 | A | 5/1996 |
| JP | 2000-272154 | | 10/2000 |
| JP | 2000272154 | A | 10/2000 |
| JP | 2001-277569 | | 10/2001 |

OTHER PUBLICATIONS

Japanese language office action dated Mar. 13, 2012 and its partial English language translation issued in corresponding Japanese application 2010517828.

Japanese language office action dated Nov. 29, 2011 and its partial English language translation for corresponding Japanese application 2010517828.

* cited by examiner

*Primary Examiner* — Kristal Feggins
(74) *Attorney, Agent, or Firm* — DLA Piper LLP (US)

(57) ABSTRACT

There are provided a recording head capable of properly maintaining the function of a protective layer, and a recording apparatus provided with the recording head. A thermal head includes a substrate, a heat-generating element disposed on the substrate, and a protective layer disposed on the heat-generating element. The protective layer includes first layers and second layers. The first layers and the second layers are laminated one after another alternately multiple times. A constituent material of the second layer having higher sublimation resistance than a constituent material of the first layer.

9 Claims, 4 Drawing Sheets

RECORDING HEAD AND RECORDING APPARATUS PROVIDED WITH THE RECORDING HEAD

CROSS-REFERENCE TO THE RELATED APPLICATIONS

This application is a national stage of international application No. PCT/JP2009/059707, filed on May 27, 2009, and claims the benefit of priority under 35 USC 119 to Japanese Patent Application No. 2008-167408, filed on Jun. 26, 2008, the entire contents of which are incorporated herein by reference.

TECHNICAL FIELD

The present invention relates to a recording head having a protective layer for covering a heat-generating element, and a recording apparatus provided with the recording head.

BACKGROUND ART

A thermal printer has been used as a printer of a facsimile, a register, and so forth. The thermal printer comprises a thermal head and a platen roller. As an example of thermal heads mountable in the thermal printer, there is known a thermal head having a plurality of heat-generating elements and a protective layer. The plurality of heat-generating elements are arranged on a substrate. The protective layer is disposed on the plurality of heat-generating elements and thus acts to protect the heat-generating elements. The platen roller acts to press a recording medium against the protective layer disposed on the heat-generating elements. Examples of the recording medium include thermal paper. In such a thermal printer, the heat-generating elements are operated to produce heat in accordance with a desired image, and also a recording medium is pressed against the protective layer disposed on the heat-generating elements in a heating state by the platen roller. In this way, heat produced by the heat-generating element is transferred to the recording medium. Desired printing onto the recording medium is accomplished by repeating such process steps.

In such a thermal printer, however, the protective layer of the thermal head mounted therein could undergo abrasion due to contact with the recording medium, which results in a decline in the function of the protective layer. In view of this a thermal head has been developed that employs a highly abrasion-resistant diamond-like carbon film (hereafter referred to as "DLC film") as a material for forming the protective layer. A thermal head of this type is disclosed for example in Patent Literature 1.

However, in the thermal head disclosed in Patent Literature 1, the DLC film could be combined with oxygen in the air and consequently sublime. Such a sublimation could occur for example in a so-called no-paper printing condition, which is a state where a heating resistive element is driven while recording-medium conveyance is suspended due to a conveyance abnormality in a conveying section of the thermal printer for conveying recording media. In the event of sublimation of the DLC film under such a condition, the abrasion resistance of the thermal head could be deteriorated significantly, which makes it impossible to properly maintain the function of the protective layer.

Patent Literature 1: Japanese Unexamined Patent Publication JP-A 7-132628 (1995)

SUMMARY OF INVENTION

Technical Problem

The invention has been devised in view of such circumstances, and its object is to provide a recording head capable of properly maintaining the function of a protective layer, and a recording apparatus provided with the recording head.

Solution to Problem

A recording head according to the invention comprises a substrate, a plurality of heat-generating elements, and a protective layer. The plurality of heat-generating elements are disposed on the substrate. The protective layer is disposed on the plurality of heat-generating elements and includes first layers and second layers. The first layers and the second layers are laminated one after another alternately multiple times. A constituent material of the second layer having higher sublimation resistance than a constituent material of the first layer.

The recording apparatus according to the invention comprises the recording head of the invention and conveyance means for conveying a recording medium.

ADVANTAGEOUS EFFECTS OF INVENTION

The recording head and the recording apparatus according to the invention succeed in properly maintaining the function of a protective layer,

DESCRIPTION OF EMBODIMENT

<Recording Head>

Figure 1:
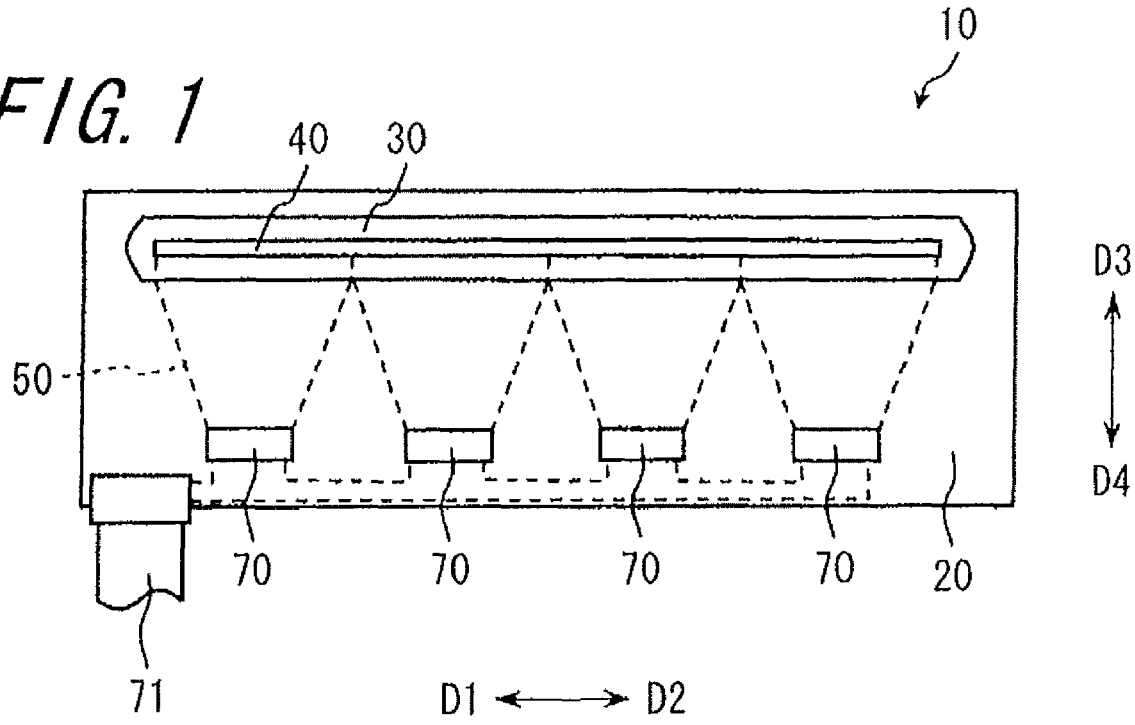
FIG. 1 is a plan view schematically showing the configuration of a thermal head which is an example of a recording head according to an embodiment of the invention.
Figure 2:
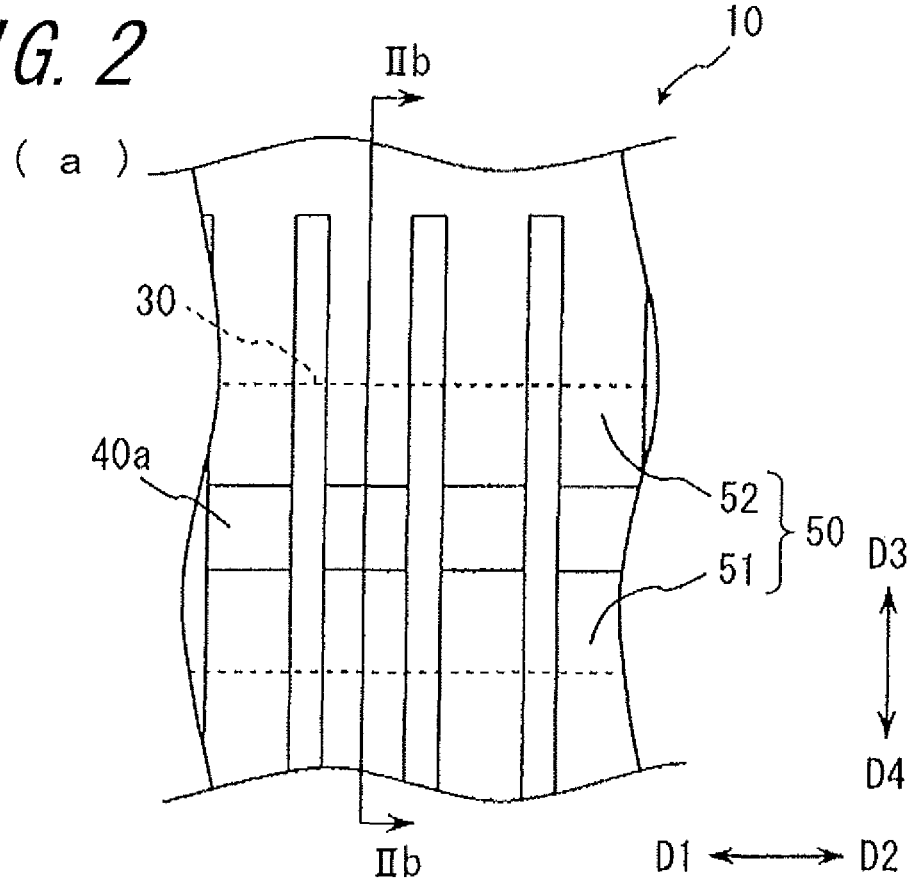
FIG. 2(*a*) is a plan view showing a main part of the thermal head shown in FIG. 1 in an enlarged state, and FIG. 2(*b*) is a sectional view of the thermal head taken along the line IIb-IIb shown in FIG. 2(*a*).
Figure 2:
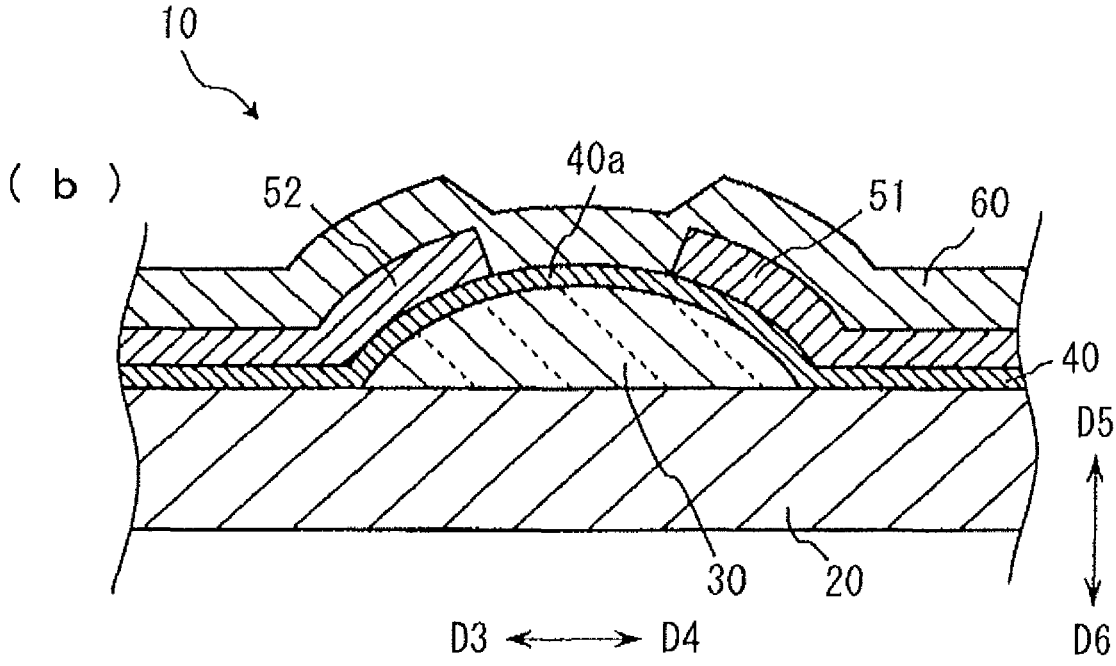
Figure 3:
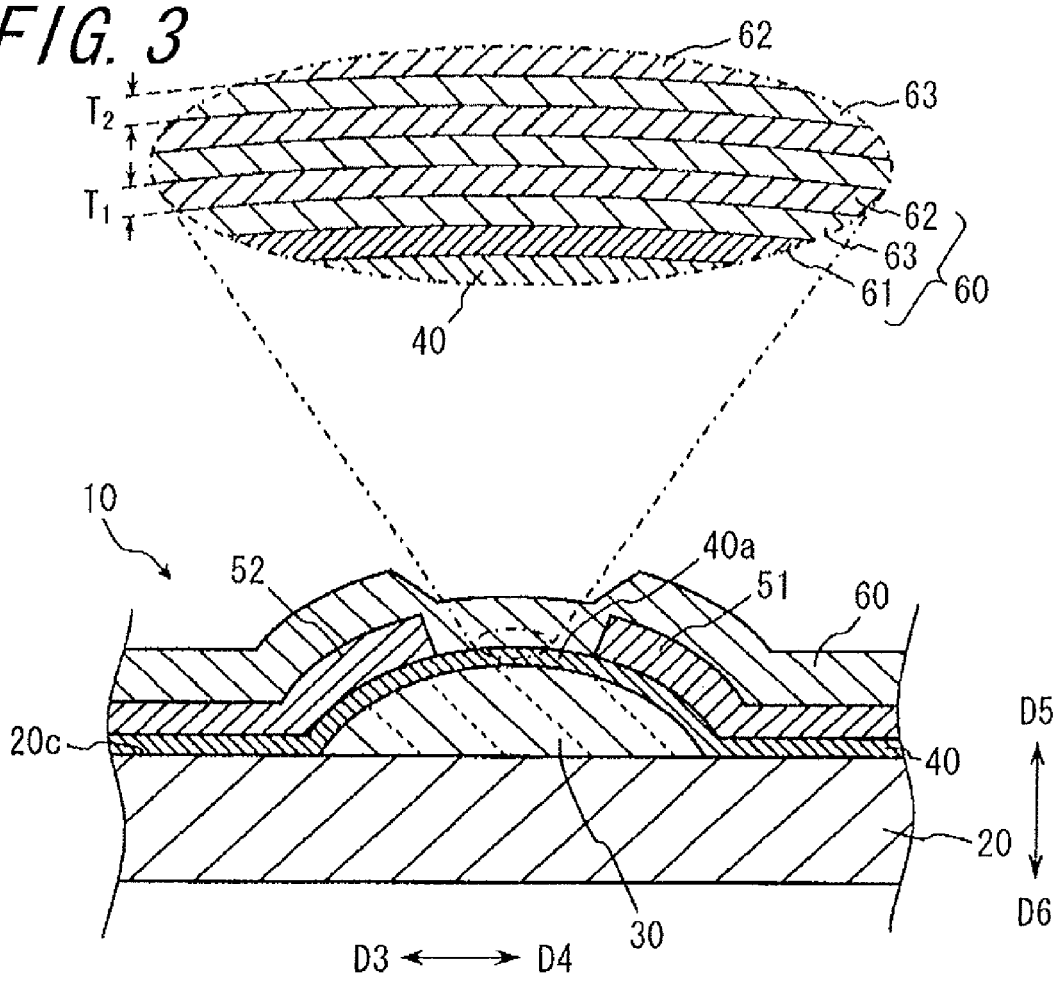
FIG. 3 is a view of a main part of a protective layer shown in FIG. 2(*b*) in a further enlarged state.

A thermal head 10 of this embodiment as shown in FIGS. 1 to 3 comprises a substrate 20, a heat storage layer 30, an electric resistance layer 40, a conductive layer 50, a protective layer 60, and a driving IC 70.

The substrate 20 acts to support the heat storage layer 30, the electric resistance layer 40, the conductive layer 50, the protective layer 60, and the driving IC 70. The substrate 20 is configured to have a rectangular shape extending in directions D1 and D2 indicated by arrows when viewed planarly. The arrow-indicated directions D1 and D2 correspond to a main scanning direction of the thermal head 1. As employed herein, "viewing planarly" refers to viewing in, of directions D5 and D6 indicated by arrows, the direction D6. The arrow-indicated directions D5 and D6 correspond to the direction of thickness of the substrate 20. Examples of materials used to form the substrate 20 include ceramic, glass, silicon, sapphire, and insulating resins including epoxy-based resin. Among these materials, glass, silicon, and sapphire are desirable from the standpoint of increasing print density.

The heat storage layer 30 has the function of temporarily accumulating part of heat produced in a heat-generating element 40*a*, which will hereafter be described, of the electric resistance layer 40. Expressed differently, the heat storage layer 30 serves to enhance the thermal responsive characteristic of the thermal head 10 by shortening the time required for a rise in the temperature of the heat-generating element 40*a*. The heat storage layer 30 is disposed on the substrate 20, and is shaped like a strip extending in the arrow-indicated directions D1 and D2. Moreover, the heat storage layer 30 is configured to be substantially semi-elliptical in cross section as seen in directions D3 and D4 indicated by arrows perpendicular to the arrow-indicated directions D1 and D2. The arrow-indicated directions D3 and D4 correspond to a sub-scanning direction of the thermal head 10. Examples of materials used to form the heat storage layer 30 include insulating materials having a thermal conductivity in a range of 0.7 $W \cdot m^{-1} \cdot K^{-1}$ or more and 1.0 $W \cdot m^{-1} \cdot K^{-1}$ or less. As employed herein, "insulation" refers to a level at which there is virtually no passage of electric current, and more specifically, for example, a condition where electric resistivity is greater than or equal to $1.0 \times 10^{12}$ Ω·m. Examples of such an insulating material include glass. It is noted that, although, in the present embodiment, the heat storage layer 30 is provided, the heat storage layer 30 does not necessarily have to be provided. In the case where the heat storage layer 30 is omitted, for example, the substrate 20 may be made of glass.

The electric resistance layer 40 has a portion acting as the heat-generating element 40*a*. The electric resistance layer 40 is configured to be greater in electric resistance value per unit length than the conductive layer 50. A part of the electric resistance layer 40 is disposed on the heat storage layer 30. In the present embodiment, in the electric resistance layer 40 which receives application of a voltage from the conductive layer 50, that part thereof on which no conductor layer 40 lies serves as the heat-generating element 40*a*. Examples of main materials for forming the electric resistance layer 40 include a TaN-based material, a TaSiO-based material, a TaSiNO-based material, a TiSiO-based material, a TiSiCO-based material, and a NbSiO-based material.

The heat-generating element 40*a* generates heat through application of a voltage. The heat-generating element 40*a* is so designed that the temperature of heat generated through application of a voltage from the conductive layer 50 falls in a range of 200° C. or higher and 550° C. or lower. A plurality of heat-generating elements 40*a* are disposed on the top surface of the heat storage layer 30. The plurality of heat-generating elements 40*a* are arranged along the arrow-indicated directions D1 and D2. In the present embodiment, the direction of arrangement of the plurality of heat-generating elements 40*a* conforms to the main scanning direction of the thermal head 10.

The conductive layer 50 acts to apply a voltage to the heat-generating element 40*a*. The conductive layer 50 is disposed on the electric resistance layer 40. Moreover, the conductive layer 50 comprises a first conductive layer 51 and a second conductive layer 52. Examples of main materials for forming the conductive layer 50 include one of the following metals: aluminum, gold, silver, and copper, and an alloy of these metals, The first conductive layer 51 is divided into a plurality of segments. The respective first conductive layers 51 have their one ends connected to corresponding one ends of the plurality of heat-generating elements 40*a* in an electrically independent state. Moreover, the other ends of the respective first conductive layers 51 are electrically connected to the driving IC 70. Looking in the arrow-indicated directions D3 and D4, the first conductive layer 51 is disposed on the side of the heat-generating element 40*a* toward the direction D4.

The second conductive layer 52 is made in one-piece form. The second conductive layer 52 has its end electrically connected to the other ends of the plurality of heat-generating elements 40*a*, as well as to a non-illustrated power source. Looking in the arrow-indicated directions D3 and D4, the second conductive layer 52 is disposed on the side of the heat-generating element 40*a* toward the direction D3.

The protective layer 60 of the present embodiment, the main part of which is illustrated in FIG. 3, acts to protect the heat-generating element 40*a* and the conductive layer 50. The protective layer 60 is configured to cover the heat-generating element 40*a* and a part of the conductive layer 50. Examples of main materials for forming the protective layer 60 include a diamond-like carbon material (DLC material), an SiC-based material, an SiN-based material, an SiCN-based material, an SiON-based material, an SiONC-based material, an SiAlON-based material, an $SiO_2$-based material, a $Ta_2O_5$-based material, a TaSiO-based material, a TiC-based material, a TiN-based material, a $TiO_2$-based material, a $TiB_2$-based material, an AlC-based material, an AlN-based material, an $Al_2O_3$-based material, a ZnO-based material, a $B_4C$-based material, and a BN-based material. As employed herein, "diamond-like carbon material" refers to a film in which the proportion of carbon atoms (C atoms) having $sp^3$ hybrid orbital is greater than or equal to 1% by atom but less than 100% by atom. Moreover, where the term "X-based material" is concerned, for example, an SiC-based material is a material composed of Si atoms and C atoms. It is possible to use a material having different composition ratios, to say nothing of a material having a stoichiometric composition, as such a material. Further, "material containing X-based material as a main material" refers to a material in which the proportion of a main substance is greater than or equal to 50% by mass with respect to the total composition, and therefore, for example, an additive can be contained therein.

Moreover, the protective layer 60 comprises an underlying layer 61, a plurality of first layers 62, and a plurality of second layers 63. The underlying layer 61 is in contact with the electric resistance layer 40 and the conductive layer 50. The first layers 62 and the second layers 63 are disposed on the underlying layer 61, and are laminated one after another alternately.

The underlying layer 61 is interposed between the electric resistance layer 40 and conductive layer 50 and the first layers 62 and second layers 63. Examples of functions of the underlying layer 61 include: increasing adherability between the electric resistance layer 40 and the conductive layer 50 as well as the first layer 62 or the second layer 63; sealing the electric resistance layer 40 and the conductive layer 50 against the outside; insulating the electric resistance layer 40 and the conductive layer 50 from the first layer 62 and the second layer 63; and reducing the difference in level between the electric resistance layer 40 and the conductive layer 50. It is preferable that the underlying layer 61 has at least one of the functions thus far described. As employed herein, "insulation" refers to a level at which there is virtually no passage of electric current, and more specifically, for example, a condition where electric resistivity is greater than or equal to $1.0 \times 10^{12}$ Ω·m. Since the underlying layer 61 of the present embodiment is made of an SiN-based material, it is possible to seal the electric resistance layer 40 and the conductive layer 50 properly against the outside. As employed herein, "sealing" refers to covering of the electric resistance layer 40 and the conductive layer 50 for the purpose of reduction in the influence of external atmosphere. By virtue of the sealing, for example, it is possible to retard corrosion of the material constituting the conductive layer 50 caused by Na ions contained in a recording medium and so forth. As employed herein, "corrosion" refers to, as defined in Glossary of terms JIS Z 0103-1996, a phenomenon in which metal is chemically or electrochemically eaten away or is subjected to material quality degradation due to surrounding environmental substances.

The first layer 62 and the second layer 63 serve mainly as a sliding surface. The material used to form the first layer 62 is superior to the material used to form the second layer 63 in point of one of basic protection characteristics. On the other hand, the material used to form the second layer 63 is superior to the material used to form the first layer 62 in point of sublimation resistance. It is preferable that the second layer 63 is made of a material that is not sublimed in a temperature range of 550° C. or lower which is the heating temperature of the heat-generating element 40*a*. As employed herein, "basic protection characteristics" refer to, for example, abrasion resistance, insulation property, and scalability. Moreover, "abrasion resistance" refers to, for example, a resistance to abrasion caused by a sliding movement of a recording medium on a surface of the protective layer 60. Further, "sublimation resistance" refers to, for example, a resistance to sublimation caused by application of heat generated from the heat-generating element 40*a* and so forth. One second layer 63 is disposed, in an exposed state, on the side of a group of all the first layers 62 toward the arrow-indicated direction D5. That is, in the present embodiment, the outermost layer of the protective layer 60 is the second layer 63. A thickness $T_1$ of the first layer 62 and a thickness $T_2$ of the second layer 63 can be set to fall in a range of 10 nm or more and 100 nm or less, for example. In the present embodiment, the thickness $T_2$ of the second layer 63 is made larger than the thickness $T_1$ of the first layer 62. Moreover, the number of alternate laminations of the first layers 62 and the second layers 63 can be set to fall in a range of 10 times or more and 100 times or less, for example. In the present embodiment, for the purpose of suppressing sublimation of the first layer 62 and enhancing thermal transferability via the protective layer 60, the first layers 62 and the second layers 63 are laminated one after another alternately 60 times.

The first layer 62 of the present embodiment is made of a diamond-like carbon material from the viewpoint of enhancing the abrasion resistance of the protective layer 60. Moreover, the second layer 63 is made of an SiC-based material from the viewpoint of suppressing sublimation of the first layer 62 and enhancing abrasion resistance. In the SiC-based material, the content of C atoms is higher than that of Si atoms from the viewpoint of enhancing abrasion resistance. The content of C atoms can be set to fall in a range of 50% by atom or more and 90% by atom or less, for example. Moreover, in the present embodiment, the second layer 63 is in contact with the underlying layer 61 from the viewpoint of increasing adherability to the SiN-based material.

The driving IC 70 has the function of controlling conditions of power supply to the plurality of heat-generating elements 40*a*. The driving IC 70 is electrically connected to the other end of the first conductive layer 51. By virtue of this construction, it is possible to cause the heat-generating elements 40*a* to produce heat in a selective manner. Moreover, an external connection member 71 is electrically connected to the driving IC 70.

The external connection member 71 has the function of supplying electric signals for driving the heat-generating elements 40*a*. Examples of the electric signals include driving power for the driving IC 70, a clock signal for timing control, an image signal corresponding to an image to be printed, and driving power to be fed to the heat-generating element. For example, a combination of a flexible cable and a connector can be used for the external connection member 71.

The thermal head 10 comprises the substrate 20, the heat-generating elements 40*a* disposed on the substrate 20, and the protective layer 60 disposed on the heat-generating elements 40*a*. The protective layer 60 includes the first layers 62 and the second layers 63. The first layers 62 and the second layers 63 are laminated one after another alternately multiple times. The constituent material of the second layer 63 has higher sublimation resistance than the constituent material of the first layer 62. Therefore, in the thermal head 10, for example, even if one first layer 62 is sublimed under the no-paper printing condition, by virtue of one second layer 63 disposed under the one first layer 62, sublimation of another first layer 62 disposed under the one second layer 63 can be suppressed. Accordingly, in the thermal head 10, it is possible to suppress sublimation of the first layer 62 and thereby maintain the function of the protective layer 60 satisfactorily.

In the thermal head 10, the thickness $T_2$ of the second layer 63 is made larger than the thickness $T_1$ of the first layer 62. Therefore, even if the thickness of the second layer 63 is reduced due to for example abrasion, the effect of suppressing sublimation of the first layer 62 can be kept satisfactorily. Accordingly, in the thermal head 10, it is possible to maintain the function of the protective layer 60 more satisfactorily.

In the thermal head 10, the constituent material of the second layer 63 contains the same C atoms as those of the constituent material of the first layer 62. This helps increase the adherability between the first layer 62 and the second layer 63.

In the thermal head 10, the second layer 63 is in an exposed state. That is, since one second layer 63 of the thermal head 10 is disposed above all of the first layers 62, it is possible to suppress sublimation of the first layer 62 by virtue of the second layer 63, and thereby maintain the function of the protective layer 60 more satisfactorily.

The protective layer 60 of the thermal head 10 further includes the underlying layer 61 which has higher sealability than the first layer 62 and the second layer 63, differs in constituent material from the first layer 62 and the second layer 63, and is in contact with the heat-generating element 40*a*. In this case, sealability, which is one of the functions demanded in the protective layer 60, can be allocated to the underlying layer 61. This allows greater flexibility in the selection of materials used to form the first layer 62 and the second layer 63.

In the thermal head 10, since the first layer 62 is a film containing a diamond-like carbon material as a main material, it is possible to enhance the abrasion resistance of the protective layer 60, as well as to exploit the effect of the second layer 63 to suppress sublimation of the first layer 62.

In the thermal head 10, since the second layer 63 is a film containing an SiC-based material as a main material, it is possible to enhance abrasion resistance even further, as well as to increase adherability to the first layer 62 made of a diamond-like carbon-based material.

<Recording Apparatus>

Figure 4:
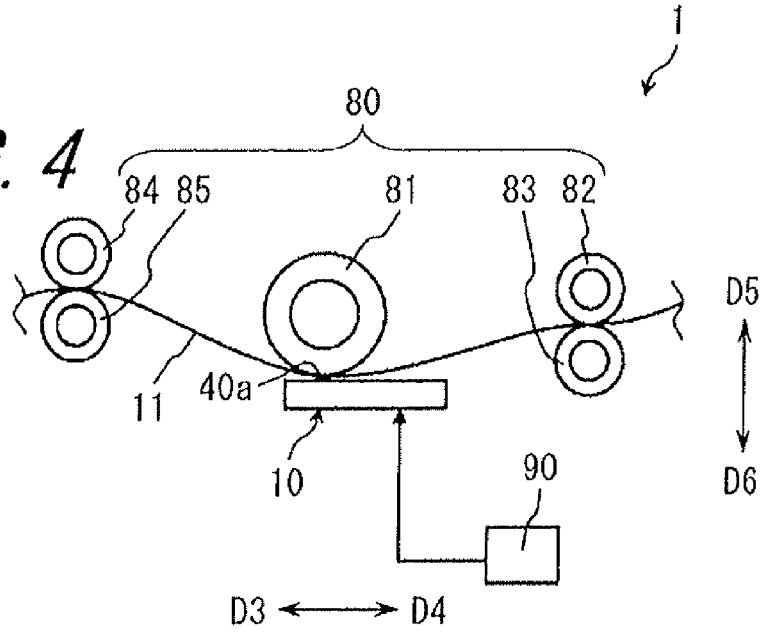
FIG. 4 is a view schematically showing the configuration of a thermal printer which is an example of a recording apparatus according to an embodiment of the invention.

A thermal printer 1 of the present embodiment as shown in FIG. 4 comprises the thermal head 10, a conveyance mechanism 80, and a control mechanism 90.

The conveyance mechanism 80 has the function of conveying a recording medium 11 in, of the arrow-indicated directions D3 and D4, the direction D3, while bringing the recording medium 11 into contact with the heat-generating element 40*a* of the thermal head 10. The conveyance mechanism 80 is composed of a platen roller 81 and conveying rollers 82, 83, 84, and 85.

The platen roller 81 acts to press the recording medium 11 against the heat-generating element 40*a*. The platen roller 81 is rotatably supported in contact with the protective layer 60 disposed on the heat-generating element 40*a*. The platen roller 81 is constructed by applying a coating of an elastic member to the outer surface of a cylindrical base body. The base body is made of a metal such for example as stainless. The elastic member is made for example of butadiene rubber having a thickness dimension in a range of 3 mm or more and 15 mm or less.

The conveying rollers 82, 83, 84, and 85 act to convey the recording medium 11. More specifically, the conveying rollers 82, 83, 84, and 85 feed the recording medium 11 to a region between the heat-generating element 40*a* of the thermal head 10 and the platen roller 81, and also pull out the recording medium 11 from the region between the heat-generating element 40*a* of the thermal head 10 and the platen roller 81. The conveying rollers 82, 83, 84, and 85 may be formed of a metal-made cylindrical member, for example, just like the platen roller 81, each of them may be constructed by applying a coating of an elastic member to the outer surface of a cylindrical base body.

The control mechanism 90 has the function of supplying image signals to the driving IC 70. More specifically, the control mechanism 90 acts to supply image signals for driving the heat-generating elements 40*a* in a selective manner to the driving IC 70 via the external connection member 71.

The thermal printer 1 comprises the thermal head 10 and is therefore able to exploit the advantageous effects of the thermal head 10. Thus, the durability of the thermal printer 1 can be enhanced by maintaining the function of the protective layer 60 of the thermal head 10 properly.

While the invention has been shown in several forms, it is to be understood that the invention is not so limited but is susceptible of various changes and modifications without departing from the gist of the invention.

Figure 5:
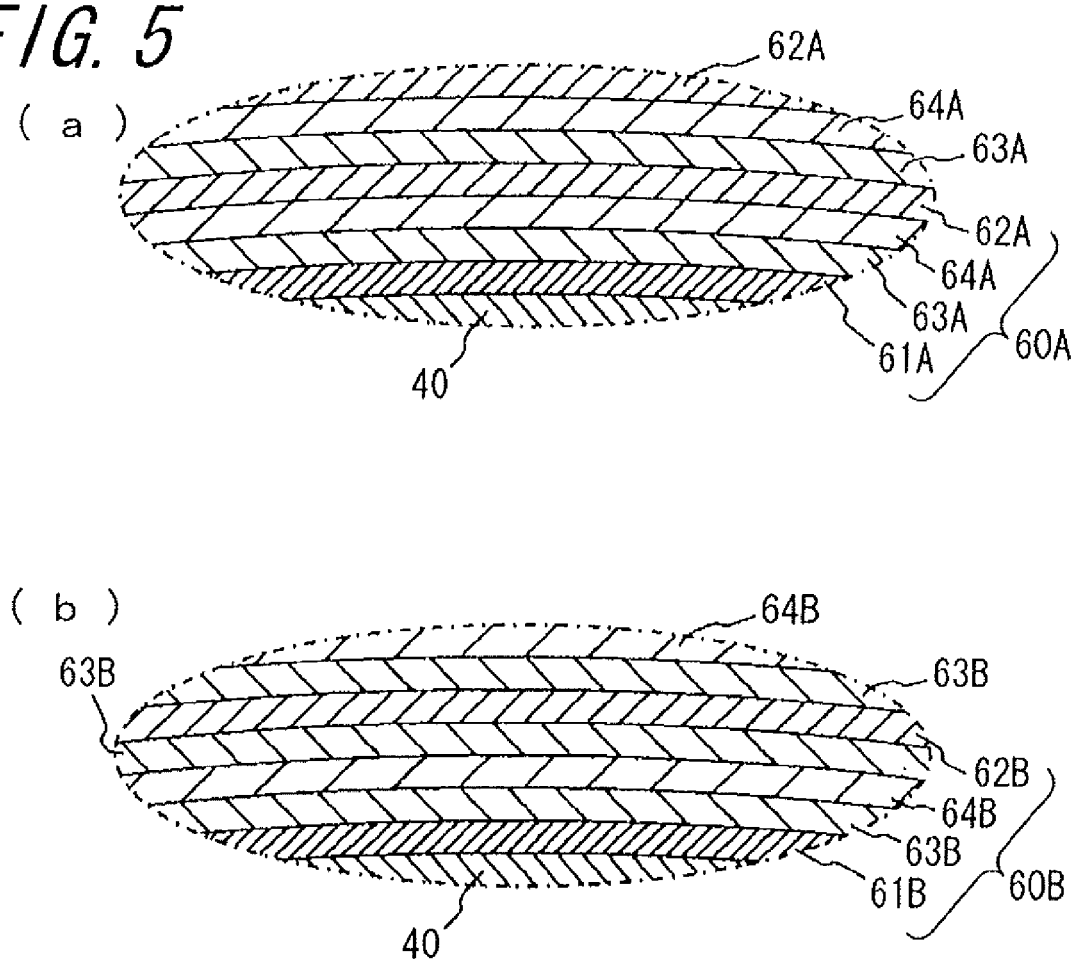
FIGS. 5(*a*) and 5(*b*) are views each showing a modified example of the protective layer shown in FIG. 3.

While, in the present embodiment, the protective layer 60 is composed of the underlying layer 61, the first layer 62, and the second layer 63, the configuration of the protective layer 60 is not so limited. For example, as shown in FIG. 5(*a*), it is possible to provide a protective layer 60A composed of, in addition to a first layer 62A and a second layer 63A, a third layer 64A, in which the three layers: 62A, 64A, and 63A are laminated one after another alternately over and over again. In another alternative, as shown in FIG. 5(*b*), it is possible to provide a protective layer 60B further comprising, in addition to a first layer 62B and a second layer 63B, a third layer 64B, in which the first layer 62B or the third layer 64B and the second layer 63B are laminated regularly alternately over and over again. It is noted that each of reference symbols 61A and 61B denotes an underlying layer.

Figure 6:
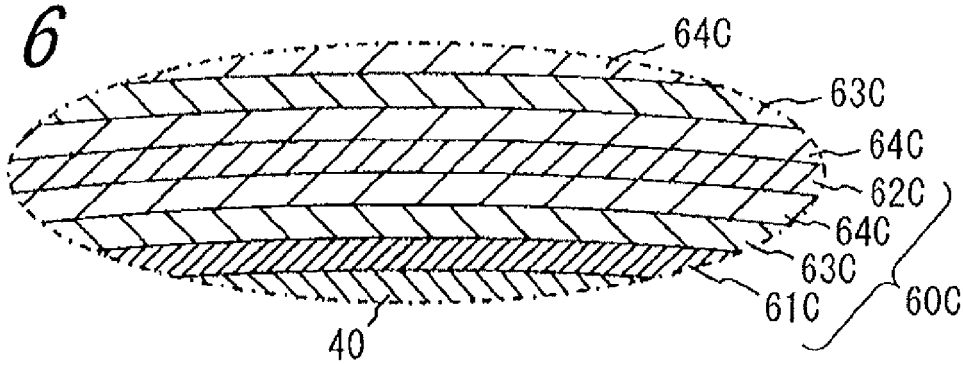
FIG. 6 is a view showing a modified example of the protective layer shown in FIG. 3.

While, in the present embodiment, the protective layer 60 is composed of the first layer 62 and the second layer 63, the configuration of the protective layer 60 is not so limited. For example, as shown in FIG. 6, it is possible to provide a protective layer 60C constructed by interposing a third layer 64C between a first layer 62C and a second layer 63C. In this configuration, when the adherability of the third layer 64C to the first layer 62C is higher than that to the second layer 63C, the adherability between the first layer 62C and the second layer 63C can be increased. This allows greater flexibility in the selection of materials used to form the first layer 62C and the second layer 63C. Examples of a material which lends itself to use for such a third layer 64C include an Si-based material.

While, in the present embodiment, a diamond-like carbon-based material is adopted for use for the first layer 62 of the protective layer 60 from the standpoint of enhancing abrasion resistance, the material for the first layer 62 is not limited thereto.

While, in the present embodiment, an SiC-based material is adopted for use for the second layer 63 of the protective layer 60 from the standpoint of enhancing abrasion resistance, the material for the second layer 63 is not limited thereto. As the second layer, for example, in the case of adopting an SiN-based material, sticking resistance can be enhanced. In the case of adopting an SiON-based material or an $SiO_2$-based material, sealability can be enhanced. Moreover, in the case of adopting a TaO-based material, it is possible to suppress melting of the protective layer 60 resulting from a thermochemical reaction.

While, in the present embodiment, the protective layer 60 includes the underlying layer 61, the configuration is not so limited. The first layer 62 or the second layer 63 may be formed directly on the electric resistance layer 40 and the conductive layer 50.

While, in the present embodiment, the protective layer 60 is in an exposed state, the configuration is not so limited. For example, a coat layer made of fluorine-based resin, or a charge-eliminating layer made of an electrically conductive material can be formed on the top surface of the protective layer 60.

EXPERIMENTAL EXAMPLES

In this example, experiments have been conducted on the resistance to sublimation of the thermal head. Concretely, with use of a thermal head in which an SiN-based material is used for the underlying layer, a DLC material is used for the first layer, and an SiC-based material is used for the second layer, the thickness of the SiC-based material that allow suppression of sublimation of the DLC material were examined by experiment.

To begin with, thermal heads A, B, C, and D according to Examples of the invention, and a thermal head E according to Comparative Example were manufactured. Concretely, at first, a head substrate common to the thermal heads A, B, C, D, and E was produced under the following conditions. It is noted that, in this example, a description about a wiring layer will be omitted, and a dimension along the main scanning direction will be referred to simply as "width" and a dimension along the sub-scanning direction will be referred to simply as "length".

<Thermal Head Configuration>

Constituent material of underlying layer: SiN-based material

Constituent material of first layer: DLC material

Constituent material of second layer: SiC-based material (not provided in thermal head E)

Number of times first layer and second layer are laminated: 1 layer for each

Thickness of first layer: 2.5 μm

Sublimation temperature of first layer: ca. 350° C.

Composition ratio in second layer: Si:C=20:80

Thickness of second layer: 500 Å (for A), 300 Å (for B), 200 Å (for C), 100 Å (for D)

Material for electric resistance layer: TaSiO-based material

Width of heat-generating element: 69 μm

Length of heat-generating element: 110 μm

Resistance value of heat-generating element: 3280 Ω/l dot

Next, stress tests have been performed using the thermal heads A, B, C, D, and E thereby produced. The stress test is a test of applying electric pulses of uniform width repeatedly at regular intervals. In the stress test of this time, a voltage value is increased for every 10000 times applications of electric pulses, and the electric-pulse applications are continued until a predetermined voltage is reached. With the electric pulses, the heat-generating element is driven repeatedly, with a consequent rise in the temperature of the protective layer disposed on the heat-generating element. It is noted that the thermal head is so designed that the temperature of the protective layer is raised gradually upon application of electric pulses ranging from 1 V to 30 V and the protective film is eventually heated to 350° C. or higher under cumulative heating.

<Conditions for Stress Test>

Cycle of electric pulse: 1.535 msec

Width of electric pulse: 1.134 msec

Voltage for electric pulse; +1 V per 10000 pulses

Initial voltage for electric pulse: 1 V

Maximum voltage for electric pulse: 32 V

Next, the second layer of each of the thermal heads A, B, C, and D having been subjected to the stress test was removed by means of dry etching. It is noted that the internal temperature of a chamber was set at or below 350° C. to prevent the first layer from subliming during the dry etching process.

<Conditions for Dry Etching>

Atmospheric pressure in chamber: 25 Pa

Temperature in chamber: 150° C.

Time spent in dry etching: 6 minutes (for A), 3 minutes (for B), 3 minutes (for C), 2 minutes (for D)

Lastly, a surface observation has been performed on each of the thermal heads A, B, C, and D having been subjected to the dry etching and the thermal head E having been subjected to the stress test by means of an optical microscope. Sublimation of the DLC material was examined by the surface observation. In Table 1, there is shown the result of confirmation.

TABLE 1

| Thermal head | SiC thickness | Presence of sublimation |
|---|---|---|
| A | 500 Å | Absent |
| B | 300 Å | Absent |
| C | 200 Å | Absent |
| D | 100 Å | Absent |
| E | — | Present |

As will be understood from the test result listed in Table 1, in each of the thermal heads A, B, C, and D, sublimation of the DLC material can be suppressed. That is, it has been found that the provision of an SiC-based material having a thickness of greater than or equal to 100 Å on the DLC material makes it possible to suppress sublimation.

The invention claimed is:

1. A recording head comprising:

a substrate;

a heat-generating element disposed on the substrate; and a protective layer disposed on the heat-generating element, the protective layer including first layers and second layers, the first layers and the second layers being laminated one after another alternately multiple times, a constituent material of the second layer having higher sublimation resistance than a constituent material of the first layer.

2. The recording head according to claim 1, wherein the thickness of the second layer is larger than the thickness of the first layer.

3. The recording head according to claim 1, wherein, one of the second layers is disposed above all of the first layers.

4. The recording head according to claim 1, wherein the protective layer further includes an underlying layer which has higher sealability than the first layer and the second layer, differs in constituent material from the first layer and the second layer, and is in contact with the heat-generating element.

5. The recording head according to claim 1, wherein the protective layer includes a third layer which is disposed between the first layer and the second layer for increasing adherability between the first layer and the second layer.

6. The recording head according to claim 1, wherein the first layer is a film containing a diamond-like carbon material as a main material.

7. The recording head according to claim 6, wherein the second layer is a film containing an SiC-based material as a main material.

8. The recording head according to claim 6, wherein the second layer is a film containing a $Ta_2O_5$-based material as a main material.

9. A recording apparatus comprising:

the recording head according to claim 1; and a conveyance section configured to convey a recording medium.

* * * * *